US005388275A

United States Patent [19]

Oram

[11] Patent Number: 5,388,275

[45] Date of Patent: Feb. 14, 1995

[54] PROTECTIVE WEAR FOR FEMALE WATER SKIERS

[76] Inventor: Stephen W. Oram, 1544 Brookfield Ct., Adrian, Mich. 49221

[21] Appl. No.: 962,875

[22] Filed: Oct. 19, 1992

Related U.S. Application Data

[63] Continuation-in-part of Ser. No. 694,399, May 1, 1991, abandoned.

[51] Int. Cl.[6] ..... A41B 9/04

[52] U.S. Cl. ..... 2/406; 2/400; 2/401; 2/408; 450/102; 450/103; 604/391; 604/393; 604/396

[58] Field of Search ..... 2/2, 2.5, 22, 23, 24, 2/67, 400, 401, 402, 403, 406, 267, 268, DIG. 6, DIG. 7; 450/81, 98, 102, 103, 104; 604/389, 391, 393, 396, 397, 398, 401

[56] References Cited

U.S. PATENT DOCUMENTS

| | | | |
|---|---|---|---|
| 2,355,404 | 8/1944 | Virden et al. | 2/67 |
| 2,574,279 | 11/1951 | Oberle | 604/397 X |
| 2,893,393 | 7/1959 | Pressley | 128/287 |
| 2,977,957 | 4/1961 | Clyne | 604/396 |
| 2,985,170 | 5/1961 | Title | 604/396 |
| 3,065,471 | 11/1962 | Leu | 2/247 |
| 3,259,910 | 7/1966 | Diagnault | 2/24 |
| 3,599,638 | 8/1971 | Rickard | 128/288 |
| 3,909,847 | 10/1975 | Holt et al. | 2/2 |
| 4,128,902 | 12/1978 | Siebert | 2/2 |
| 4,831,666 | 5/1989 | Denman | 2/23 |

*Primary Examiner*—Jeanette E. Chapman

*Attorney, Agent, or Firm*—Willian Brinks Hofer Gilson & Lione

[57] ABSTRACT

A protective device primarily intended for female water skiers inhibits flow of water into the female reproductive organs. In the preferred embodiment, the lower portion of a swimsuit includes a pocket in the crotch region and a slit on the interior wall of the crotch for providing access to the pocket. In an alternate embodiment, the swimsuit includes a region of hook or loop fasteners disposed on the interior wall of the crotch region. In the preferred embodiment, a deflector which comprises outer layers of a soft, resilient material and a thin inner layer of more rigid, fluid impervious material is placed either in the pocket or secured by complementary hook and loop fasteners. An alternate embodiment comprehends a generally hourglass shaped sponge which is fabricated of open or preferably closed cell foam and which is placed in the pocket or includes complementary hook and loop fasteners for securing to the crotch region of the swimsuit.

14 Claims, 3 Drawing Sheets

PROTECTIVE WEAR FOR FEMALE WATER SKIERS

CROSS REFERENCE TO COPENDING APPLICATION

This patent application is a continuation-in-part of patent application Ser. No. 07/694,399, filed May 1, 1991, now abandoned.

BACKGROUND OF THE INVENTION

The invention relates generally to protective apparel for athletes and more specifically to protective swim wear for female water skiers, windsurfers and the like.

Water skiing and windsurfing rate as exhilarating and thus popular warm weather sports. They are relatively safe but for the occasional mishap in which the skier is pitched into the water. Such an incident, contemporarily referred to as a "wipeout", may subject the skier or windsurfer to forceful contact with water and rapid deceleration from speeds in the range from 20 to 40 miles per hour (29 to 59 kilometers per hour) and higher. The risks of such a mishap are conventionally assessed in terms of joint or ligament and occasionally bone injury.

A serious but little known or appreciated problem relates to the flow or relatively forceful injection of water to the female reproductive organs during a ski mishap. Such action may forcefully drive water up the vagina, through the cervix and into the uterus, not only damaging tissue but initiating infection from bacteria and microorganisms in the water. The medical and health related consequences of such an event can range from negligible to life threatening.

A survey of existing art reveals a distinct lack of both appreciation for this problem and means addressed to its solution.

Various protective wear has been designed for both male and female users. For example, U.S. Pat. No. 3,788,314 discloses a combination athletic garment for the lower body having stretchable leg portions and a pouch in the central interior portion for receiving a protector cup.

U.S. Pat. No. 4,128,902 teaches padded shorts intended especially for female gymnasts. The shorts include a pouch in the interior front portion which receives a two layer foam pad wherein the layers have different densities. U.S. Pat. No. 4,229,835 discloses another padded undergarment. Here, the pad is described as thin and resilient and appears primarily intended to provide support and comfort for seated athletes such as cyclers and riders. U.S. Pat. No. 4,462,115 presents a protective undergarment for women for use in playing volleyball and includes shock-absorbing pads disposed generally on the sides of the undergarment to protect the hips and adjacent anatomy.

In U.S. Pat. No. 4,969,216, a padded undergarment is disclosed which is intended to provide comfort during lengthy periods of sitting. The undergarment includes a cushion sewn into its seat and provides comfort and protection to the spinal cord. U.S. Pat. No. 3,909,847 teaches a female pelvis and crotch protector having a shock-absorbing pad held over the pelvis and crotch region by a complementary pocket in the undergarment. The pad comprises a relatively hard, flexible outer layer laminated to a relatively soft, flexible inner layer.

While the foregoing described devices provide varying degrees of protection against impact and injury to the lower torso region, it is clear that none address or resolve the problem discussed above which applicant has addressed.

A review of the swimsuit art prompts a similar conclusion. For example, U.S. Pat. No. 2,457,219 teaches a swimsuit fabricated almost entirely of sponge rubber material. The sponge rubber is a closed cell configuration and thus provides flotation. U.S. Pat. No. 2,060,689 discloses a bathing suit for women which includes a non-transparent fabric strip which provides concealing means for the crotch of the wearer as well as reinforcement thereto. A similar feature is illustrated in U.S. Pat. No. 2,355,404. The garment disclosed there, which appears to be primarily intended for men, includes a crotch which is reinforced by a diamond shaped insert.

Finally, there are devices which provide minimal covering for bathing and other activities. For example, U.S. Pat. No. 3,339,208 discloses a resilient contoured loop brief formed of spring material which is placed between the legs of the wearer. A device affording similar minimal protection though intended for a distinct purpose is disclosed in U.S. Pat. No. 4,905,323. Here, in its preferred embodiment, a thin strip of polypropylene is connected at its looped ends to a thin endless elastic band. The device is intended for use by women while trying on clothing prior to purchase.

Examination of the foregoing art reveals that there are no devices specifically intended for, nor adaptable to, protective wear for a female water skier or windsurfer of the type disclosed and claimed herein by applicants.

SUMMARY OF THE INVENTION

A protective device primarily intended for female water skiers inhibits flow of water into the female reproductive organs. In the preferred embodiment, the lower portion of a swimsuit includes a pocket in the crotch region and a slit on the interior wall of the crotch for providing access to the pocket. The slit may be either longitudinally, i.e., front to back or transversely disposed. In an alternate embodiment, the swimsuit includes a region of hook or loop fasteners disposed on the interior wall of the crotch region. The preferred embodiment deflector comprehends a generally hourglass shaped sponge which is fabricated of open or preferably closed cell foam and which is placed in the pocket or includes complementary hook or loop fasteners for securing to the crotch region of the swimsuit. In an alternate embodiment, a relatively thin, hourglass shaped deflector comprises outer layers of a soft, resilient material and a thin inner layer of a more rigid, fluid impervious material. The deflector is placed either in the pocket or secured by complementary hook or loop fasteners.

It is therefore an object of the present invention to provide a protective safety assembly for female water skiers which inhibits the flow of water into the reproductive organs.

It is a further object of the present invention to provide protective wear for a female water skier which may be readily inserted and removed from a swimsuit or swimsuit trunks.

It is a still further object of the present invention to provide a soft, resilient water blocking means which may be inserted into the crotch of a swimsuit to provide protection for female water skiers.

It is a still further object of the present invention to provide a water impermeable insert for placement in the crotch of a swimsuit to provide protection to female water skiers.

Further objects and advantages of the present invention will become apparent by reference to the following description of the preferred embodiment and attached drawings.

DESCRIPTION OF THE PREFERRED AND ALTERNATE EMBODIMENTS

Figure 1:
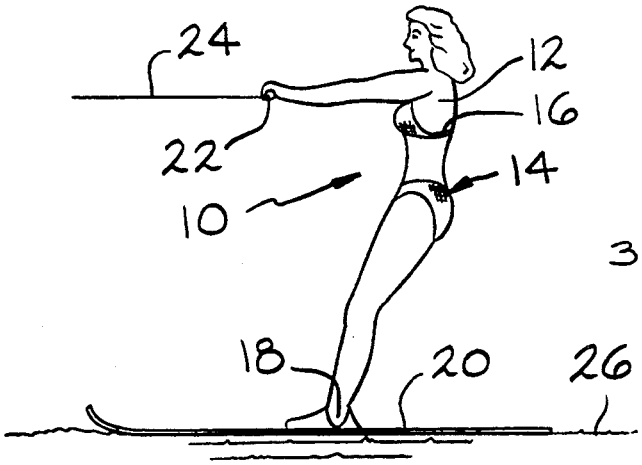
FIG. 1 is a side elevational view of the present invention in place upon a female water skier.
Figure 2:
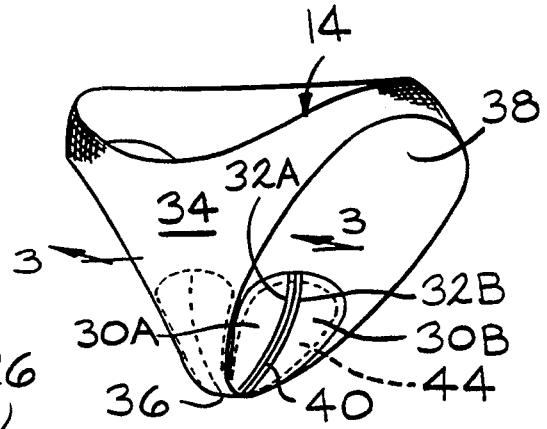
FIG. 2 is a perspective view of the lower portion of a swimsuit having a pocket and water deflecting assembly according to the present invention.

Referring now to FIGS. 1 and 2, a swimsuit 10 according to the instant invention is illustrated upon, that is, being worn, by a female water skier 12. The swimsuit 10 includes a lower or trunk portion 14 and an upper or bra portion 16. While the swimsuit 10 generally referred to as a bikini style is herein illustrated, it should be appreciated from the outset that the present invention as hereinafter described is readily adaptable to a single piece style swimsuit as well as to the two-piece, bikini style swimsuit 10 illustrated inasmuch as it relates to the lower or trunk portion 14 which is common to both swimsuit configurations. A female water skier 12 is shown in a typical pose with the feet 18 releasably secured to a pair of water skis 20. The skier 12 is gripping the handle 22 of a tow rope 24 which, at its opposite end, is secured to a motorized watercraft (not illustrated).

Ideally, the water skis 20 remain on the surface of the water 26 as illustrated. However, it is not an altogether uncommon occurrence for the skier 12 to lose concentration, balance or both and contact the water 26 at a speed of 20 to 40 miles per hour or greater. It is for this unfortunate occurrence that the present invention is designed and intended to inhibit the injection of water into the female reproductive tract. It should also be understood that the present invention may be used by female wind surfers or in any other sport in which water may forcefully contact the torso at an upward angle.

Figure 3:
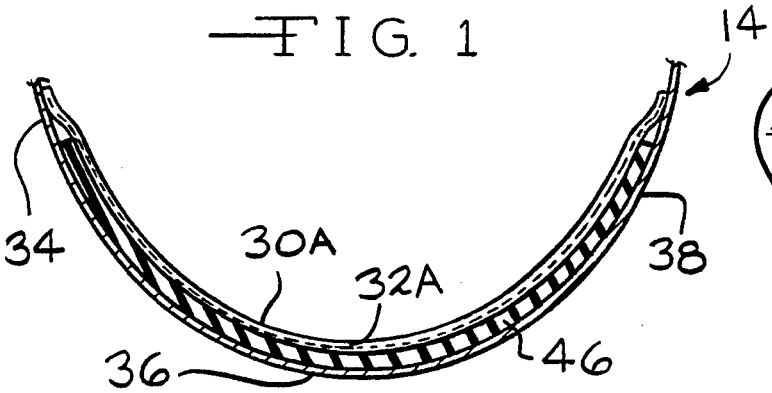
FIG. 3 is a full, sectional view of a preferred embodiment of a swimsuit and water deflecting assembly according to the present invention.

As illustrated in FIGS. 2 and 3, the preferred embodiment of the lower or trunk portion 14 of the swimsuit 10 includes a left flap 30A and a right flap 30B preferably disposed on the interior, crotch portion of the trunk portion 14. The left flap 30A and the right flap 30B may be integrally formed from or with the interior panels of the trunk portion 14 or may be an additional layer of fabric or material which is secured to the inside of the truck portion 14 by sewing, an adhesive or other suitable means. The left flap 30A and the right flap 30B define respective opposed marginal edges, namely, a left marginal edge 32A and a right marginal edge 32B. The marginal edges 32A and 32B extend generally along an interior vertical mid plane of the trunk portion 14 from a anterior, forward panel 34, downwardly and rearwardly through the crotch region 36 and upwardly and rearwardly to the posterior or rear panel 38.

The marginal edges 32A and 32B thus define a slit 40 which is similarly extending, that is, from the anterior or forward panel 34, downwardly and rearwardly through the crotch region 36 and upwardly and rearwardly to the interior of the posterior or rear panel 38. The panels 34 and 38 and the crotch region, of course, define the left and right leg openings as illustrated in FIG. 2. Again, it is worth noting that the trunk portion 14 presented is illustrative and representative of swimsuits generally. Thus, the size of the leg openings and the size and cut of the panels 34 and 38 and crotch region 36 may vary greatly from the illustration. Such variation will generally not affect the application or efficacy of the present invention.

The slit 40 provides access from the interior of the trunk portion 14 to a generally hourglass shape interior pocket 44. Removably disposed within the pocket 44 is a preferably complementarily, that is, hourglass shaped, deflector assembly 46. The deflector assembly 46 of the preferred embodiment is a homogeneous, compressible material such as sponge. The to sponge material is preferably closed cell foam but may be open cell foam and may be of either synthetic or natural composition. The density of the sponge material may also vary. Generally speaking, however, relatively more dense material will perform better.

As noted, the deflector assembly 46 is shaped like an hourglass and includes a narrow, centrally disposed neck region 48 defined by opposed, concave sidewalls and two wider, generally rounded ends 50. The narrow neck region 48 is positioned in the region of the pocket 44 most proximate the crotch 36 of the trunks 14 and the wider ends 50 extend to the anterior and posterior regions of the pocket 44 generally proximate the front panel 34 and rear panel 38 of the trunk portion 14, respectively. In its uncompressed state, the sponge 46 is preferably between about three-eights inch and one inch in thickness and is uniform in thickness. When compressed, the sponge will reduce in thickness to between about one-sixteenth of an inch and one-quarter inch.

Figure 5:
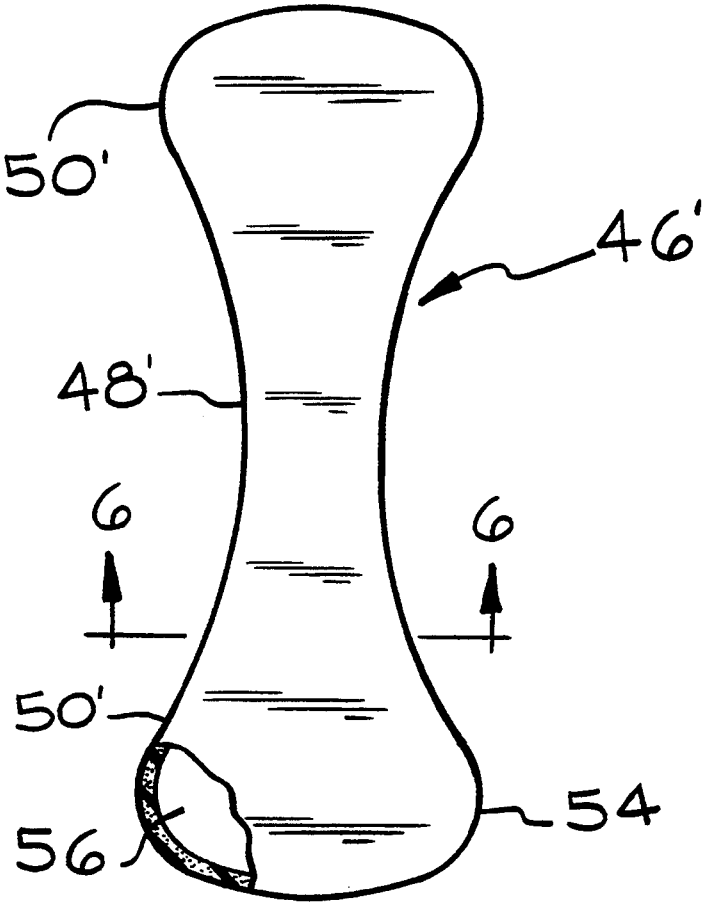
FIG. 5 is a plan view of a first alternate embodiment of a water deflecting assembly according to the present invention.
Figure 6:
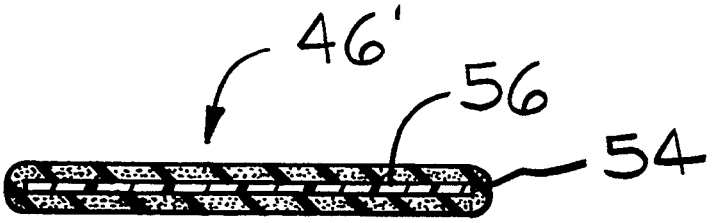
FIG. 6 is a full, sectional view of a first alternate embodiment water deflecting assembly according to the present invention taken along line 6—6 of FIG. 5.

Referring now to FIGS. 5 and 6, an alternate embodiment deflector assembly 46′ is illustrated. Here, rather than the homogeneous, fully flexible and compressible sponge of the preferred embodiment, the deflector assembly 46′ is a three layer sandwich of an outer, surrounding layer of a soft, sponge material 54 which may be either open or closed cell foam and may be in all respects similar to the material from which the preferred embodiment deflector 46 is constructed. Further, however, it includes a thin, relatively rigid central layer 56 of a fluid impermeable material such as polyethylene, polypropylene or a suitable elastomer such as rubber. The layers 54 and 56 of the deflector assembly 46' may be laminated together by the use of a suitable adhesive, solvent or other method. The alternate embodiment deflector assembly 46' also defines a centrally disposed narrow neck region 48' and two opposed, wider generally rounded ends 50'. In its uncompressed state, the deflector assembly 46' is preferably between about one-quarter and one-half inch in thickness and is uniform in thickness.

It will be appreciated that the alternate embodiment deflector assembly 46' may be substituted for and inserted into the pocket 44 of the swim trunks 14 through the slit 40 as readily and conveniently as the preferred embodiment deflector assembly 46. Preferably, the alternate embodiment deflector assembly 46' will be preformed into an open parabolic or U-shape along its longitudinal axis into the general configuration illustrated in FIG. 3 with regard to the preferred embodiment deflector assembly 46 to more readily conform to the exterior female anatomy. For purposes of illustration and clarity, however, the deflector assembly 46' has been presented in a flat, uncurved condition.

Figure 7:
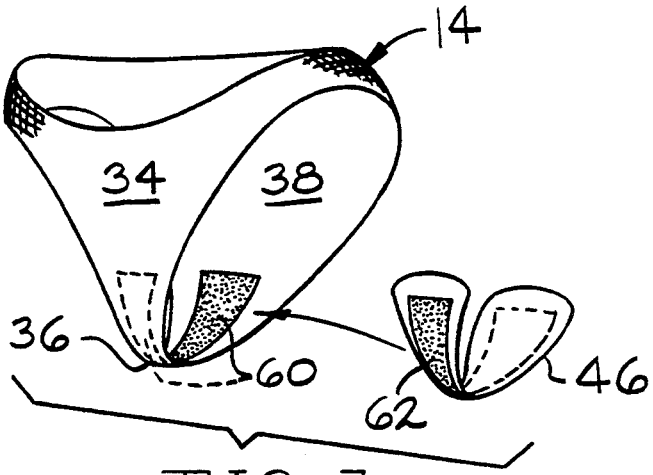
FIG. 7 is a perspective view of a first alternate embodiment of an attachment structure for a water deflecting assembly according to the present invention.

Referring now to FIG. 7, an alternate embodiment relating to the means for securing and retaining the deflector assemblies 46 and 46' within the trunk portion 14 of a swimsuit is illustrated. Disposed on the inner surface of the trunk portion 14 and extending generally from the front panel 34, downwardly and rearwardly through the crotch region 36 and generally upwardly and rearwardly to the rear panel 38 is a region of either hook or loop fasteners 60. The hook and loop fastener material may be like or similar to Velcro fastening material, for example. Velcro is a registered trademark of the Velcro Corporation. Inasmuch as the use of hook and loop fasteners is intended to permit ready and simple installation and removal of the deflector 46 or 46' from within the trunk portion 14, as well as permit wearing of the trunk portion 14 with or without the deflector 46 or 46', it has been found preferable to utilize the loop material of hook and loop fasteners on the inner surface of the trunk portion 14.

The configuration of the hook or loop material 60 may be that of a rectangular strip, a pair of isosceles triangles meeting at their narrow vertices, an hourglass shape generally complementary to the shape of the deflector assembly 46 or 46', or a pair of spaced-apart strips generally conforming to the edges of the crotch region 36 of the trunk portion 14. Hook and loop fastener material 62 is similarly complementarily disposed and secured to one surface of the deflector 46. Again, such material 62 may be disposed in a number of patterns such as a rectangular strip, an hourglass shape generally conforming to the shape of the deflector assemblies 46 and 46' a pair of strips generally disposed along the lengthwise, marginal edges or other convenient shapes. As noted, inasmuch as it has been found preferable to use the loop portion of the fastener combination as the material 60, it is therefore preferable to use the hook portion as the material 62.

Figure 8:
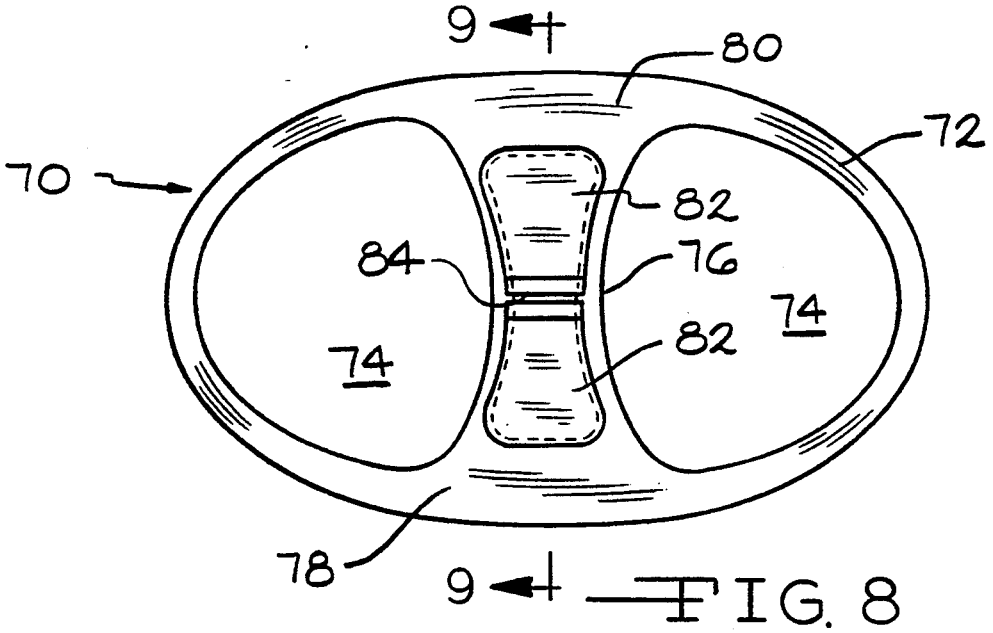
FIG. 8 is a plan view of the lower portion of a swimsuit having a pocket and water deflecting assembly according to a second alternate embodiment of the present invention.
Figure 9:
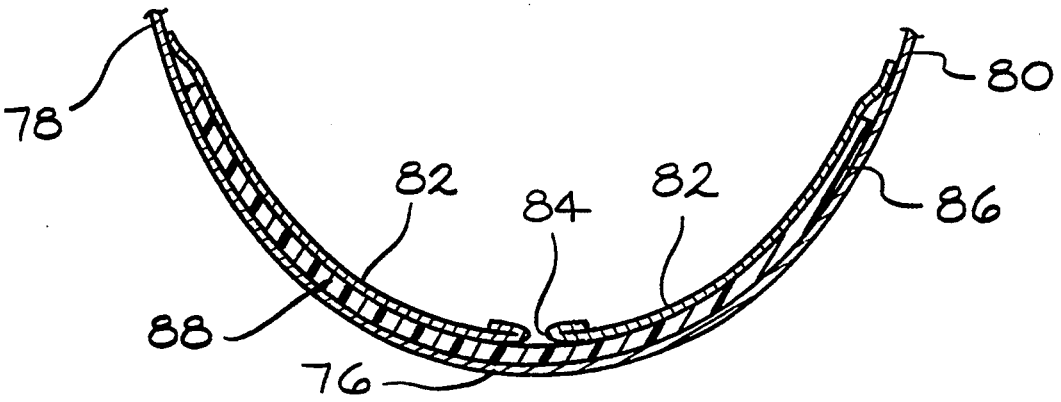
FIG. 9 is a fragmentary view in full section of a second alternate embodiment water deflecting assembly according to the present invention.
Figure 10:
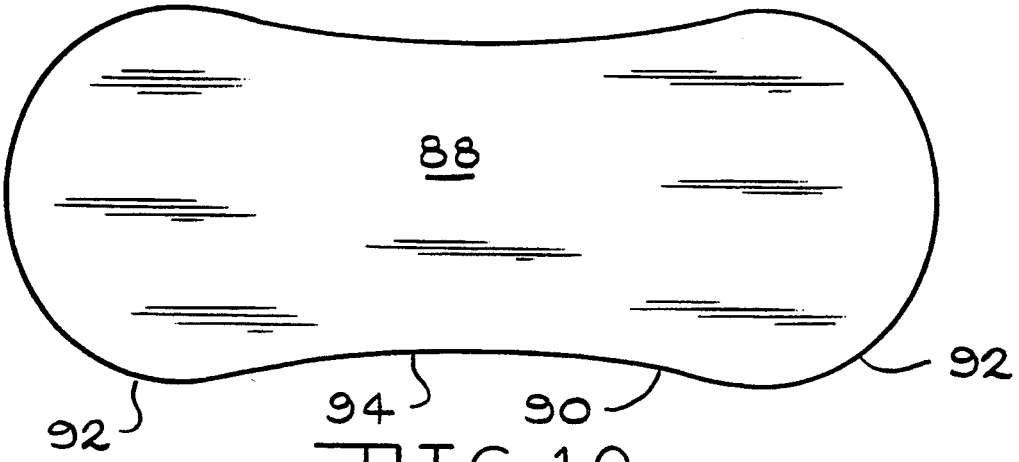
FIG. 10 is a plan view of the second alternate embodiment water deflecting assembly according to the present invention.

Referring now to FIGS. 8, 9 and 10, a second alternate embodiment 70 of the invention is illustrated. The second alternate embodiment 70 represents further variations and configurations of a swimsuit construction and deflector assembly for the above-stated purposes. The second alternate embodiment 70 includes a trunk portion 72 which is generally similar to the lower or trunk portion 14 of a swimsuit discussed above. Thus, it includes a pair of cutouts or openings 74 for the legs of a wearer and an upper opening as will be readily appreciated. Centrally located within the trunk portion 72 is a crotch panel 76 which extends between a front panel 78 and a rear panel 80 of the trunk portion 72. Secured to the inner face of the crotch panel 76 and extending generally toward the front panel 78 and rear panel 80 are a pair of generally symmetrical truncated triangular panels 82. The panels may be secured to the crotch panel 76 by sewing, stitching, adhesives, autogenous bonding or other suitable means. The opposed adjacent edges of the panels 82 define a slit 84 which provides access to an internal region or pocket 86 which receives a thin, generally non-porous pad or water deflector assembly 88. The water deflector assembly 88 may be readily inserted or removed from the pocket 86 through the slit 84. The adjacent edges of the panels 82 may be in contact to form a closed slit or may be spaced a small distance (one sixteenth to one eighth inch) apart as desired.

Figure 4:
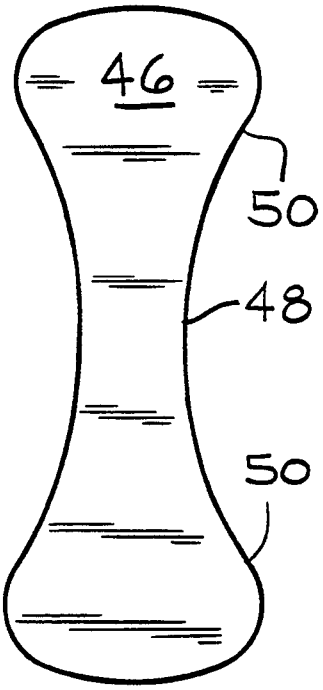
FIG. 4 is a plan view of the preferred embodiment of a water deflecting assembly according to the present invention.

The water deflector assembly 88 is preferably fabricated of closed cell, cross-linked polyethylene foam. Preferably the thickness of the water deflector assembly 88 is between one-sixteenth of an inch and one-eighth of a inch (1.5 mm. to 3.0 mm.). As illustrated in FIG. 10, the shape of the water deflector assembly 88 defines a softly curving periphery 90 having two generally rounded ends 92 and a slightly necked central region 94. When compared to the preferred embodiment deflector 46 illustrated in FIG. 4, it will be appreciated that the shapes are similar but that the pad 88 is less cinched in the central region 94.

Protective wear for female water skiers according to the present invention, provides a versatile means of self-protection. When used with a configured swimsuit trunk portion 14 having the pocket 44 or the trunk portion 72 having the pocket 86, the preferred embodiment deflector 46 of sponge material, the three layer alternate embodiment deflector assembly 46' or the closed cell foam pad deflector assembly 88 may be used to provide appropriate protection. Alternatively, either the deflector assembly 46, the deflector assembly 46' or the deflector assembly 88 may be utilized with the alternate embodiment retaining structure of the hook and loop fasteners 60 and 62 to facilitate fast and simple attachment or removal of the deflector assemblies 46 or 46' or 88 to the crotch region 36 of the trunk portion 14. With either manner of attachment, any of the deflector assemblies 46, 46' or 88 may be conveniently used to provide protection to the pelvic region and specifically the female reproductive tract.

It should also be noted that whereas the deflector assemblies 46, 46' and 88 are generally hourglass shaped, that is, comprise a narrow neck region 48, 48' and 94 and a wider pair of opposed end regions 50, 50' and 92, respectively, this symmetrical configuration has been adopted primarily to ensure proper placement of the deflector 46 within the pocket 44 or 86. That is, while primary protection is required generally somewhat forward of the crotch region 38, suggesting that merely a triangular deflector assembly consisting of only one-half of the deflector assembly 46 having one-half of the neck region 48 and one end region 50 would suffice, it is believed to be preferable from the standpoints of both installation and retention that the deflector assembly have a narrow central region and wider end regions as illustrated. However, it should be understood that inasmuch as the central feature of the invention is water deflection from the female reproductive tract during sports activities, other, similar anatomically conforming shapes will prove effective and are deemed to be encompassed by the foregoing disclosure and following claims.

The foregoing disclosure is the best mode devised by the inventor for practicing this invention. It is apparent, however, that apparatus or devices incorporating modifications and variations will be obvious to one skilled in the art of protective swimwear. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A protective device for female water skiers, windsurfers and the like, comprising, in combination, a swimsuit trunk portion defining an interior surface and an exterior surface, a substantially non-absorbent water deflector means in said trunk portion for inhibiting injection of water into the reproductive tract;

said water deflector means is a closed cell foam pad having a thickness of less than about one half inch and having a narrow center region and wider ends, and a pair of flaps each including one of a respective pair of adjacent edges, said adjacent edges defining a slit on said interior surface of said trunk portion and pocket means accessible through said slit for retaining said water deflector means in said trunk portion.

2. The protective device of claim 1 wherein said slit extends longitudinally along a crotch panel of said trunk portion.

3. The protective device of claim 1 wherein said slit extends longitudinally across a crotch panel of said trunk portion.

4. The protective device of claim 1 wherein said trunk portion includes a forward panel merging into a crotch panel and said pair of flaps defines a pocket extending from said forward panel toward said crotch panel.

5. A protective device for female water skiers, windsurfers and the like, comprising, in combination, a swimsuit trunk portion defining an interior surface having one of either hook or loop fasteners disposed thereon, a flexible, substantially non-absorbent water deflector means disposed within said trunk portion for inhibiting injection of water into the reproductive tract, said deflector means including an exterior surface having the other of either hook or loop fasteners disposed thereon said water deflector means is a closed cell foam pad having a thickness of less than about one half inch and having a narrow center region and wider ends.

6. The protective device of claim 5 wherein said water deflector means has a thickness of less than about one-eighth of an inch.

7. The protective device of claim 5 wherein said water deflector means includes a centrally disposed water impervious layer and a surrounding outer layer.

8. The protective device of claim 5 wherein said water deflector means defines an hourglass shape.

9. In a swim garment including a trunk portion having a front region, a crotch region and a rear region and defining an interior, the improvement comprising, a substantially non-absorbent water deflecting insert disposed in the interior of said trunk portion adjacent said crotch region and extending generally forward to said front region;

said water deflecting insert being a closed cell foam pad having a thickness of less than about one half inch and having a narrow center region and wider ends and, a pair of flaps disposed in said crotch region, said flaps each defining one of a respective pair of adjacent edges defining a slit and a pocket adjacent said pair of flaps and accessible through said slit for retaining said water deflecting insert generally in said crotch region and said forward region of said trunk portion.

10. The improvement of claim 7 wherein said insert includes a water impermeable material.

11. The improvement of claim 9 wherein said insert includes a water impermeable layer surrounded by a resilient material.

12. The improvement of claim 9 wherein said retaining means includes a pair of interior flaps extending generally from said crotch region to said front region, said flaps defining a pocket for receiving said deflector and a slit for permitting insertion and removal of said deflector from said pocket.

13. In a swim garment including a trunk portion having a front region and a crotch region and defining an interior, the improvement comprising, a flexible, substantially non-absorbent water deflecting insert disposed in the interior of said trunk portion adjacent said crotch region and extending generally toward said front region, said insert defining a first, narrow region disposed in said crotch region and a second, wider region disposed toward said front region and, said water deflecting insert being a closed cell foam pad having a thickness of less than about one half inch and having a narrow center region and wider ends and, a pair of flaps disposed in said interior of said trunk portion, said flaps each defining one of a respective pair of adjacent edges defining a slit, and a pocket adjacent said pair of flaps and accessible through said slit for retaining said water deflecting insert.

14. The improvement of claim 13 wherein said insert includes a thin water impermeable layer surrounded by a thicker resilient layer.

* * * * *